US007676848B2

(12) United States Patent
Motooka et al.

(10) Patent No.: US 7,676,848 B2
(45) Date of Patent: Mar. 16, 2010

(54) CATCHING TOOL FOR BASEBALL OR SOFTBALL

(75) Inventors: Ken Motooka, Osaka (JP); Kazunori Ayama, Osaka (JP)

(73) Assignee: Mizuno Corporation, Osaka (JP)

( * ) Notice: Subject to any disclaimer, the term of this patent is extended or adjusted under 35 U.S.C. 154(b) by 247 days.

(21) Appl. No.: 11/412,404

(22) Filed: Apr. 27, 2006

(65) Prior Publication Data

US 2007/0044194 A1 Mar. 1, 2007

(30) Foreign Application Priority Data

Aug. 31, 2005 (JP) ..... 2005-252109
Apr. 12, 2006 (JP) ..... 2006-110019

(51) Int. Cl.
*A41D 13/08* (2006.01)

(52) U.S. Cl. ..... 2/19; 2/161.1

(58) Field of Classification Search ..... 2/19, 2/161.1

See application file for complete search history.

(56) References Cited

U.S. PATENT DOCUMENTS 2,625,686 A * 1/1953 Latina ..... 2/19
4,192,018 A * 3/1980 Latina ..... 2/19
4,541,126 A 9/1985 Howard et al.
6,941,578 B2 * 9/2005 Anderson ..... 2/19
2005/0022282 A1 * 2/2005 Motooka et al. ..... 2/19
2005/0268367 A1 * 12/2005 Kogawa et al. ..... 2/19
2006/0218689 A1 * 10/2006 Brown ..... 2/19
2006/0272068 A1 * 12/2006 Motooka et al. ..... 2/19

FOREIGN PATENT DOCUMENTS

JP 08-005734 2/1996
JP 10-151234 6/1998

* cited by examiner

*Primary Examiner*—Katherine Moran
(74) *Attorney, Agent, or Firm*—Troutman Sanders LLP; James E. Schutz

(57) ABSTRACT

A web part comprises a lower-side web part provided on a pocket-part side of a glove and an upper-side web part provided on an opposite side relative to the pocket-part side. An extended part resulting from extension of a ball-receiving leather of a main body of the glove into between a thumb stall and a forefinger stall constitutes the lower-side web part. The lower-side web part is provided on a back side of the glove in comparison to a smoothly curved line which connects an intermediate point of the thumb stall in a thickness direction thereof and an intermediate point of the forefinger stall in a thickness direction thereof in a sectional surface in a lateral direction starting from the thumb stall, passing through the lower-side web part and reaching the forefinger stall.

8 Claims, 4 Drawing Sheets

CATCHING TOOL FOR BASEBALL OR SOFTBALL

This non-provisional application is based on Japanese Patent Applications Nos. 2005-252109 and 2006-110019 filed with the Japan Patent Office on Aug. 31, 2005 and Apr. 12, 2006, respectively, the entire contents of which are hereby incorporated by reference.

BACKGROUND OF THE INVENTION

1. Field of the Invention

The present invention relates to a catching tool for baseball or softball, and more particularly to a catching tool for baseball or softball capable of exerting an improved performance in catching a ball by improving a structure between a web part (connected part) provided between a thumb stall and a forefinger stall, and a ball-receiving leather of a glove main body.

2. Description of the Background Art

A conventional structure of a catching tool for baseball or softball (hereinafter, may be referred to as glove) is described below. A surface leather of the glove is obtained in such a manner that peripheral edges of a ball-receiving leather having a substantially five-finger shape and a back leather obtained by sewing parts formed from a plurality of leathers so that five finger stalls are formed are sewn together, except for a hand inserting part, so that grain sides of the both leathers face inward, and the sewn leathers are turned over so that the grain sides face outward.

A lining leather of the glove is obtained in such a manner that peripheral edges of a palm leather cut in a size smaller than that of the surface leather and having a substantially five-finger shape and a back-side leather obtained by sewing parts formed from a plurality of leathers so that five finger stalls are formed are sewn together, except for a hand inserting part, so that grain sides of the both leathers face inward.

A core formed from felt or the like, a shock absorbing member, and the like are inserted into a predetermined part of the surface leather, and the predetermined part is impregnated with oil. Thereafter, the lining leather is inserted, and the hand inserting parts of the surface leather and the lining leather are joined with each other with a leather string. Thereby, a main body of the glove is formed. A web part separately formed (ball-receiving part) is also provided between a thumb stall and a forefinger stall of the glove main body, and the web part, thumb stall, and forefinger stall are joined with one another with a leather string. Then, the production of the glove is completed.

So far have been disclosed different structures in which the web part is improved. For example, Japanese Patent Laying-Open No. 10-151234 discloses a web part in which the ball-receiving part is formed in such a manner that a horizontal bar is provided so as to extend from an edge of the thumb stall through an edge of the forefinger stall, a vertical bar is penetrated through from a substantially central part of the horizontal bar through a base part between the thumb stall and the forefinger stall, and horizontal bars separately formed are provided with respect to the vertical bar from substantially central parts from the thumb stall and the forefinger stall. Japanese Utility Model Publication No. 08-005734 discloses a web part provided with enough plasticity and extendability to naturally a form pocket for receiving a ball in such a manner that a plurality of slits respectively concentrically placed in different groups are provided at a central part and in a periphery of the central part, minimum intervals between the central part and the respective slits of the particular group are substantially equal, and the minimum intervals are different in each group.

However, in the structures of the conventional web parts disclosed in the Japanese Patent Laying-Open No. 10-151234 and Japanese Utility Model Publication No. 08-005734 and the like, the web part and the glove main body are formed from separate members and thereafter integrated, which inevitably generates gaps, steps, joined parts and the like between the glove main body (more specifically, the base part between the thumb stall and the forefinger stall on the ball-receiving leather of the glove main body) and the web part. The presence of the uneven parts due to the gaps, steps, joined parts and the like on the surface of the glove in contact with the ball when the ball is caught reduces an area in which a surface of the ball having a spherical shape and the uneven surface of the glove are in contact with each other. As a result, the ball could not be held firmly enough, which disadvantageously deteriorated a ball-catching performance of the glove.

SUMMARY OF THE INVENTION

Therefore, an object of the present invention is to solve the foregoing problem and provide a catching tool for baseball or softball whose ball-catching performance is improved.

A catching tool for baseball or softball according to an aspect of the present invention includes a web part between a thumb stall and a forefinger stall, wherein the web part includes a lower-side web part provided on a pocket-part side of the catching tool and an upper-side web part provided on an opposite side relative to the pocket-part side, the lower-side web part and a ball-receiving leather are formed from a single sheet of leather, and the lower-side web part is provided on an outer side than a smoothly curved line which connects an intermediate point of the thumb stall in a thickness direction thereof and an intermediate point of the forefinger stall in a thickness direction thereof in a sectional surface in a lateral direction starting from the thumb stall, passing through the lower-side web part and reaching the forefinger stall.

In the catching tool according to the above aspect of the present invention, the uneven parts due to the steps, gaps, joined parts and the like, which were described above, are hardly generated on the surface of the catching tool, and an area where a ball and the catching tool are in contact with each other when the ball is caught is increased because the lower-side web part and the ball-receiving leather of the main body of the catching tool are formed from a single sheet of leather. Further, because the lower-side web part is provided on the outer side than the web part of the conventional catching tool, such a structure that the lower-side web part has a depth when observed from the ball-receiving-surface side is provided. Thereby, the ball can be held as if wrapped in the glove, which improves the ball-catching performance.

A catching tool for baseball or softball according to another aspect of the present invention includes a ball-receiving leather provided on a palm side of a user's hand and constituting at least a part of a ball-receiving surface, a back leather provided on a back-side of the user' hand and connected with the ball-receiving leather, a thumb stall for receiving a thumb of the user's hand, a forefinger stall for receiving a forefinger of the user's hand, and a connected part provided in a region between the thumb stall and the forefinger stall to thereby connect the thumb stall and the forefinger stall, wherein an extended part resulting from extension of the ball-receiving leather to the region between the thumb stall and the forefinger stall constitutes at least a part of the connected part.

In the catching tool according to the another aspect of the present invention, the uneven parts due to the steps and the like between the main body of the catching tool and the connected part can be reduced because the extended part resulting from the extension of the ball-receiving leather to the region between the thumb stall and the forefinger stall constitutes at least a part of the connected part. According to the constitution, the ball-catching performance of the catching tool can be improved in the same manner.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Hereinafter, preferred embodiments of the present invention are described. A glove (catching tool) according to the present invention has a constitution basically the same as that of a conventional glove in any part other than a characteristic constitution in a ball-receiving leather and a web part (connected part). More specifically, a main body of the glove includes a surface leather constituting a surface of the glove and a lining leather inserted into the surface leather and constituting an inner side of the glove. The surface leather includes at least a back leather and a ball-receiving leather, and the lining leather includes at least a back-side leather and a palm-side leather.

The back leather is obtained in such a manner that parts formed from a plurality of leathers are integrated by means of sewing or the like so that five finger stalls are formed, and the ball-receiving leather has a substantially five-finger shape. The surface leather is obtained in such a manner that peripheral edges of the ball-receiving leather and the back leather, except for a hand inserting part, are sewn together so that grain sides of the both leathers face inward, and the sewn leathers are turned over so that the grain sides face outward. The surface leather has outer-side finger stalls including an outer-side thumb stall, an outer-side forefinger stall, an outer-side middle finger stall, an outer-side fourth finger stall, and an outer-side little finger stall.

The lining leather is obtained by sewing peripheral edges of the palm leather having a substantially five-finger shape and cut in a size smaller than that of the surface leather and the back-side leather obtained in such a manner that parts formed from a plurality of leathers so that five finger stalls are formed, except for a hand inserting part thereof, so that grain sides of the both leathers face inward. The lining leather has inner-side finger stalls including an inner-side thumb stall, an inner-side forefinger stall, an inner-side middle finger stall, an inner-side fourth finger stall, and an inner-side little finger stall.

A core formed from felt or the like, a shock absorbing member, and the like are inserted into a predetermined part of the surface leather, and the predetermined part is impregnated with oil. Thereafter, the lining leather is inserted, and the hand inserting parts of the surface leather and the lining leather are joined with each other with a leather string. The respective inner-side finger stalls are inserted into the corresponding outer-side finger stalls.

The back leather, ball-receiving leather, back-side leather, palm-side leather and web part described later can adopt natural leather, artificial leather, or any of materials having the same qualities as these leathers.

Figure 1:
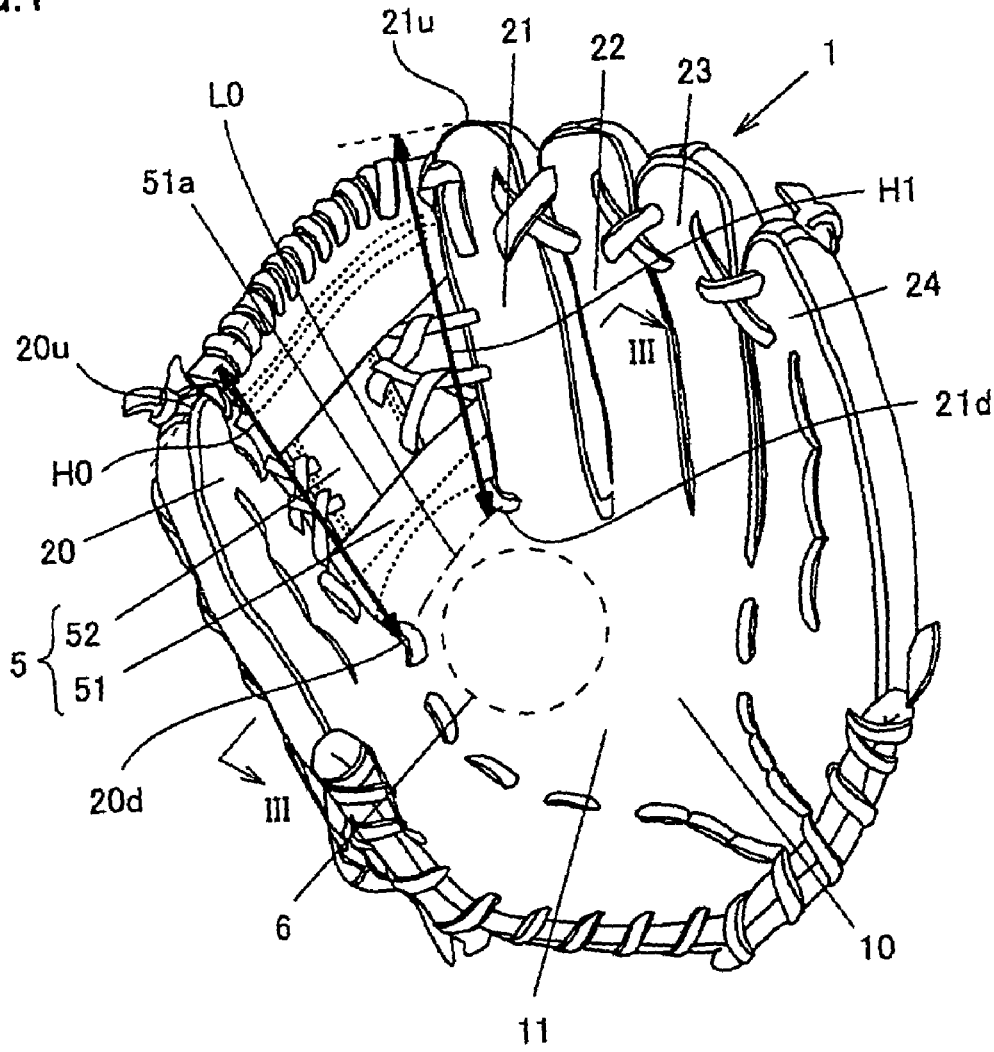
FIG. 1 is a front view of a glove according to a preferred embodiment of the present invention.
Figure 2:
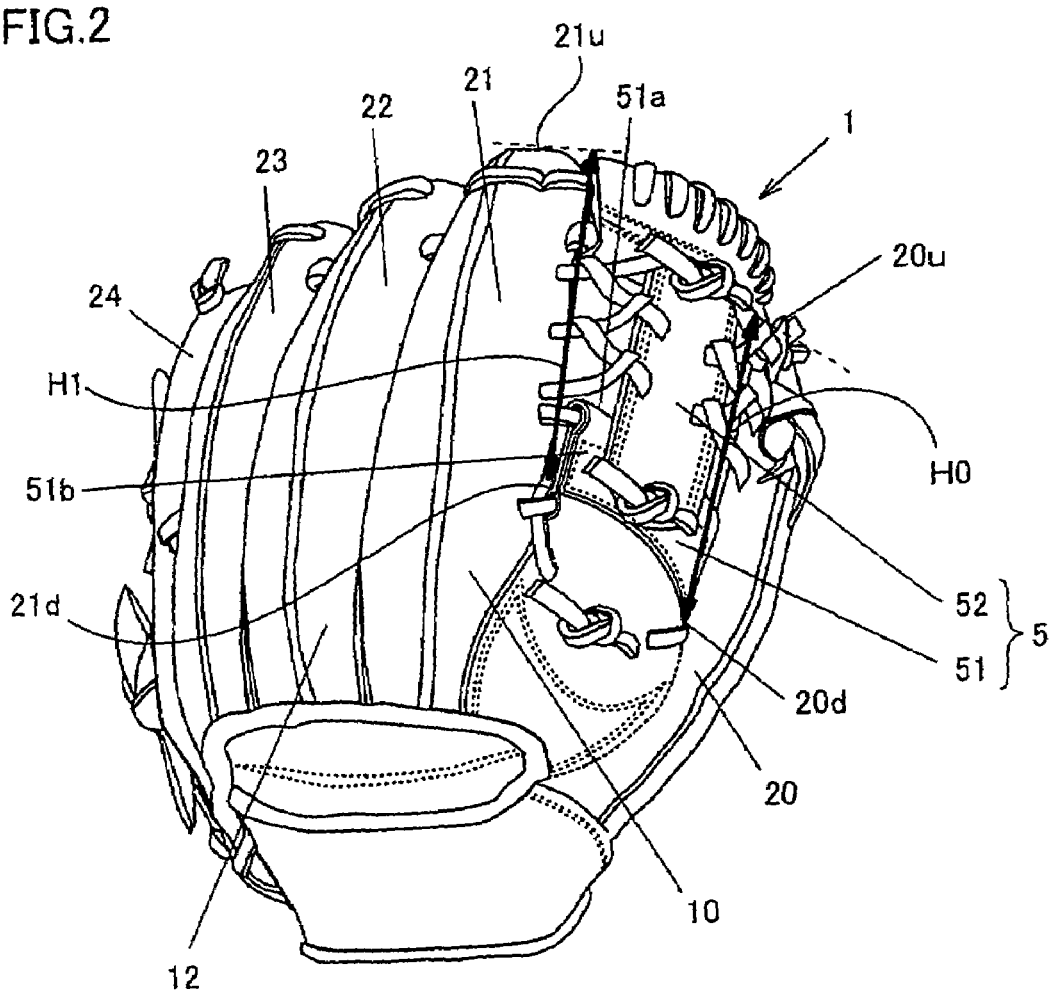
FIG. 2 is a rear view of the glove according to the preferred embodiment of the present invention.
Figure 3:
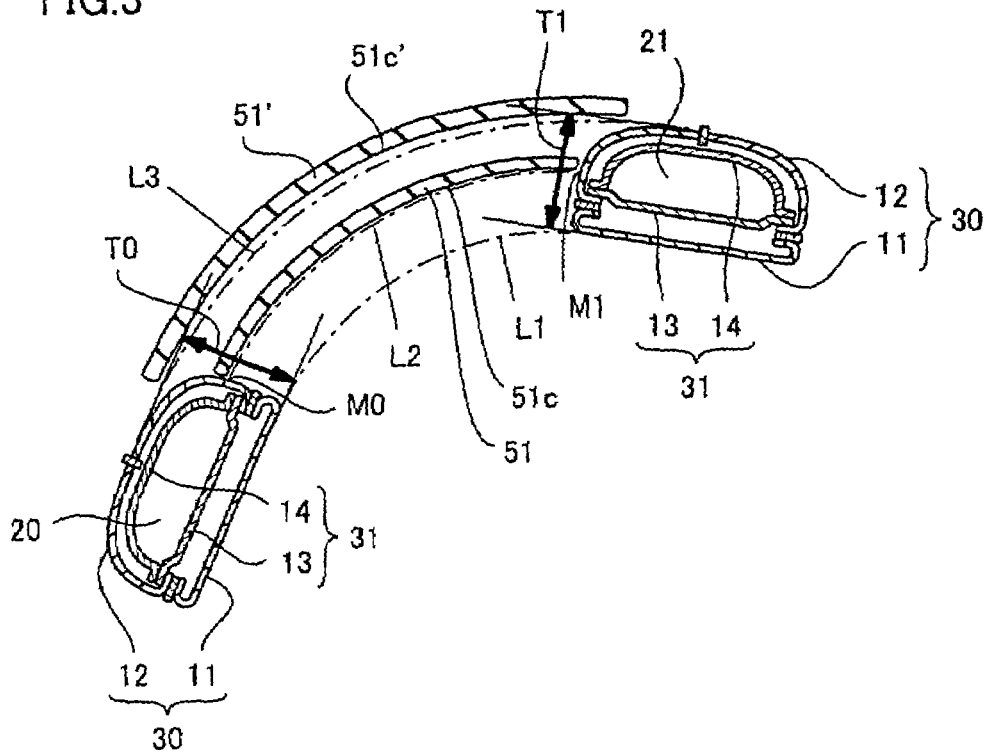
FIG. 3 is a schematic illustration of a sectional structure taken along III-III line shown in FIG. 1.

Next, shapes of the ball-receiving leather of the glove main body, web part and vicinity thereof are described referring to the drawings. FIG. 1 is a front view of a glove according to the present invention (glove is in an open state). FIG. 2 is a rear view of the glove according to the present invention. FIG. 3 show a cross sectional surface in a lateral direction starting from the thumb stall, passing through the web part and reaching the forefinger stall, which is a schematic illustration presented for describing a sectional structure taken along III-III line shown in FIG. 1.

A glove 1 according to the present invention includes a thumb stall 20, a forefinger stall 21, a middle finger stall 22, a fourth finger stall 23 and a little finger stall 24, which respectively receive fingers. In each of the finger stalls, an inner-side finger stall is placed inside an outer-side finger stall. A pocket part 6 is provided at a central part of a ball-receiving leather 11 of a main body 10 of the glove, and a web part 5 is provided in a region between thumb stall 20 and forefinger stall 21.

Web part 5 is a connected part which connects thumb stall 20 and forefinger stall 21 as shown in FIG. 1. In the example shown in FIG. 1, web part 5 includes a lower-side web part (connected part on a root side) 51 provided on the pocket-part-6 side of main body 10 of the glove and an upper-side web part (connected part on an edge side) 52 adjacent to lower-side web part 51 and provided on a hem side of the glove (opposite side relative to pocket-part-6 side). Lower-side web part 51 and ball-receiving leather 11 of main body 10 of the glove are formed from a single sheet of leather. More specifically, an extended part resulting from extension of ball-receiving leather 11 to a region between thumb stall 20 and forefinger stall 21 constitutes lower-side web part 51.

Lower-side web part 51 is provided so as to have a depth when observed from the ball-receiving-surface side as described later. In order for a sufficient depth to be obtained, it is necessary for lower-side web part 51 to have a certain length from the pocket side toward the hem side of the glove. More specifically, a distance from a curved line L0 obtained by perpendicularly projecting a straight line which connects a root 20*d* of thumb stall 20 on the web-part side and a root 21*d* of forefinger stall 21 on the web-part side on ball-receiving leather 11 through an upper-end part 51*a* of the lower-side web part is necessarily at least 10 mm. Alternatively, lower-side web part 51 can be extended only in the depth direction, and the upper-side web part can be provided in the perpendicular direction.

Lower-side web part 51 and upper-side web part 52 of web part 5 can be described based on ratios thereof. Upper-end part 51*a* of lower-side web part 51 is located to be included in a region surrounded by a scope of at least 10% from the root at a height H0 from root 20*d* of thumb stall 20 on the side of web part 5 through an edge 20*u* of the thumb stall and a scope of at least 10% from the root at a height H1 from root 21*d* of forefinger stall 21 on the side of web part 5 through an edge 21*u* of the forefinger stall. When the foregoing values are less than 10%, it becomes difficult for lower-side web part 51 to be supplied with a sufficient depth. An upper-limit value of the foregoing values is 100%, which is a value in the case where the lower-side web part constitutes the entire web part.

In the case of glove 1 shown in FIGS. 1 and 2, the height from root 20*d* of thumb stall 20 on the side of web part 5 through edge 20*u* of the thumb stall is 118 mm, and the height from root 20*d* through upper-end part 51*a* of lower-side web part 51 is 36 mm. Therefore, upper-end part 51*a* of lower-side web part 51 is located at 30.5% from root 20*d*. Further, the height from root 21*d* of forefinger stall 21 on the side of web part 5 through edge 21*u* of the forefinger stall is 125 mm, and the height from root 21*d* through upper-end part 51*a* of lower-side web part 51 is 37 mm. Therefore, upper-end part 51*a* of lower-side web part 51 is located at 29.6% from root 21*d*.

As described later, the shape of lower-side web part 51 is not particularly limited as far as lower-side web part 51 is provided so as to have the enough depth when observed from the ball-receiving surface side.

In the case of the glove shown in FIGS. 1 and 2, a folded piece 51*b* is provided in upper-end part 51*a* of lower-side web part 51 so that a tube-shape part (folded part) is formed at the hem of the glove, and a leather string (insertion member) is inserted through the tube-shape part so that thumb stall 20, forefinger stall 21 and upper-end part 51*a* of the lower-side web part are secured to one another.

Upper-side web part 52 constitutes any region of web part 5 other than the lower-side web part and is provided on the hem side of the glove. Describing the shape of the upper-side web part, as shown in FIGS. 1 and 2, a band-shape leather in the lateral direction is provided in the hem part of the upper-side web part, a band-shape leather is provided in the vertical direction where the band-shape leather and the lower-side web part are connected with each other, and a mesh-shape leather string is provided in the part where the gaps are generated in the leathers. However, the shape is not limited to such a shape, and may have an arbitrarily shape in accordance with a shape of the conventional web part (shape in which the band-shape leather is provided in a cross shape or a Y-letter shape, shape in which the mesh-shape leather string is provided or the like).

Figure 5:
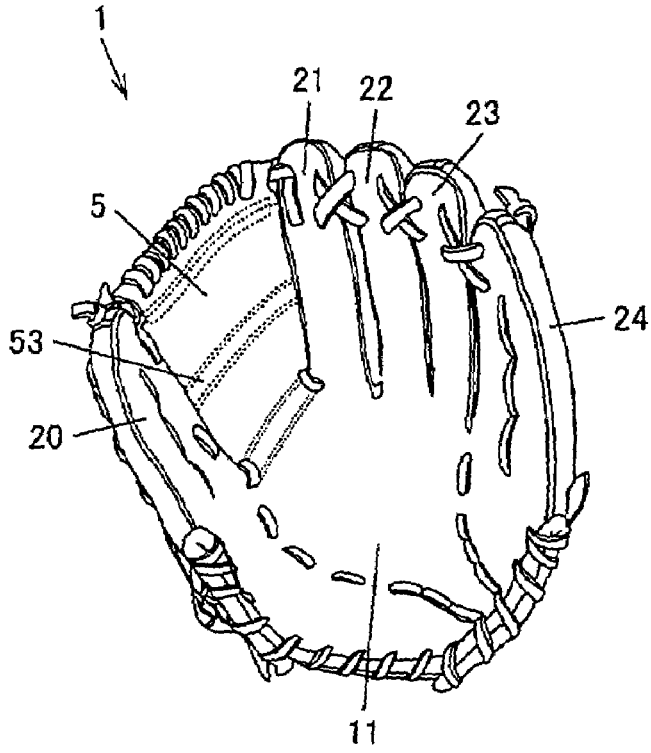
FIG. 5 is a front view of a glove according to another preferred embodiment of the present invention.
Figure 6:
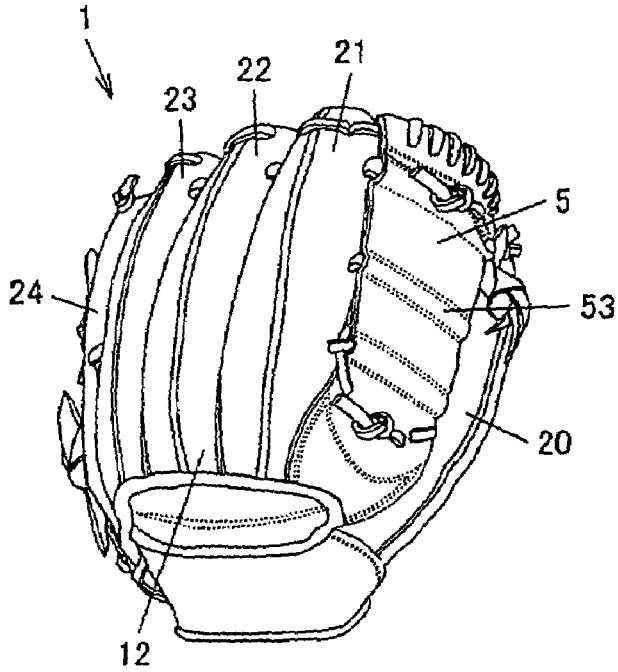
FIG. 6 is a rear view of the glove according to the another preferred embodiment of the present invention.

In place of using the separate members for lower-side web part 51 and upper-side web part 52, ball-receiving leather 11 of the glove main body, lower-side web part 51 and upper-side web part 52 may be formed from a single sheet of leather. FIGS. 5 and 6 show an example in which lower-side web part 51 and upper-side web part 52 are thus formed from a single sheet of leather so that web part 5 is integrally provided. In the case of the example, web part 5 can be formed, for example, in such a manner that the single sheet of leather is folded back. Further, the folded-back leather is selectively sewn so that web part 5 is provided with a folded-back part and a singular or a plurality of leather string insertion parts 53, and leather strings (insertion members) are inserted through the folded-back part and the leather string insertion parts 53. Then, web part 5 can be secured to thumb stall 20 and forefinger stall 21 with the leather strings (insertion members).

Next, the position of lower-side web part 51 in the sectional-surface direction in the lateral direction starting from the thumb stall, passing through the lower-side web part and reaching the forefinger stall shown in FIG. 3 is described. First, respective components shown in FIG. 3 are described. In thumb stall 20 and forefinger stall 21 respectively, an outer-side finger stall 30 of the surface leather is formed from ball-receiving leather 11 and a back leather 12, and an inner-side finger stall 31 of the lining leather is formed from a palm-side leather 13 and a back-side leather 14.

Figure 4:
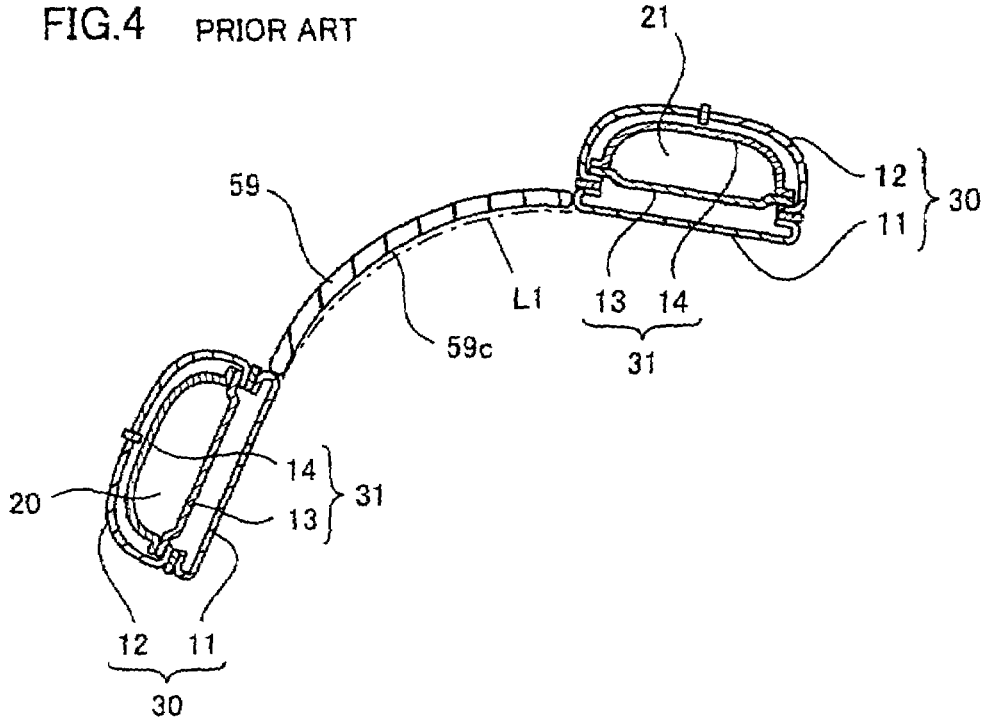
FIG.4 PRIOR ART
FIG. 4 is a schematic illustration of a sectional structure of a conventional glove (at the same position as shown in FIG. 3)

FIG. 4 shows a sectional surface of the conventional glove, wherein the sectional surface at the same position as that of FIG. 3 is shown. As shown in FIG. 4, a ball-receiving surface 59*c* of a web part 59 in the conventional glove is provided to be substantially flush with a smoothly curved line L1 (shown in a dotted and dashed line in FIG. 4) which connects an inner side of ball-receiving leather 11 of thumb stall 20 and an inner side ball-receiving leather 11 of forefinger stall 21.

In the glove exemplified in the present invention, as shown in FIG. 3, a ball-receiving surface 51*c* of lower-side web part 51 is provided on an outer side than a smoothly curved line L2 (shown in a dotted and dashed line in FIG. 3) which connects an intermediate point M0 of thumb stall 20 in a thickness direction T0 and an intermediate point M1 of forefinger stall 21 in a thickness direction T1. More specifically, ball-receiving surface 51*c* of lower-side web part 51 (connected part on the root side) is provided on the back side of glove 1 in comparison to the surface of thumb stall 20 on the side of ball-receiving leather 11 at a position adjacent to lower-side web part 51 and the surface of forefinger stall 21 on the side of ball-receiving leather 11 at a position adjacent to lower-side web part 51. In other words, lower-side web part 51 is provided between thumb stall 20 and forefinger stall 21 so that a part of back leather 12 constituting thumb stall 20 and a part of back leather 12 constituting forefinger stall 21 are connected to each other. Further, in other words, lower-side web part 51 is retreated onto the back side of glove 1 relative to thumb stall 20 at the position adjacent to lower-side web part 51 and forefinger stall 21 at the position adjacent to lower-side web part 51 so that a space can be formed in a region in a forward direction of lower-side web part 51 and between thumb stall 20 and forefinger stall 21. When ball-receiving surface 51*a* of lower-side web part 51 is provided on the outer side, lower-side web part 51 can deep enough when observed from the ball-receiving-surface side. Thereby, when the ball is caught in vicinity of lower-side web part, the ball can be held as if wrapped in the glove in comparison to conventional web part 59 shallower in depth.

As shown in FIG. 3, a ball-receiving surface 51*c*' of a lower-side web part 51' can be provided on an outer side than a smoothly curved line L3 (shown in a dotted and dashed line in FIG. 3) which connects an outer side of back leather 12 of thumb stall 20 and an outer side of back leather 12 of forefinger stall 21 (lower-side web part 51' is provided on the further outer side than back leather 12 of thumb stall 20 and back leather 12 of forefinger stall 21). More specifically, ball-receiving surface 51*c*' of lower-side web part 51' (connected part on the root side) may be provided on the back side of glove 1 in comparison to the surface of thumb stall 20 on the side of back leather 12 at a position adjacent to lower-side web part 51' (back of thumb stall 20) and the surface of forefinger stall 21 on the side of back leather 12 at a position of adjacent to lower-side web part 51'(back of forefinger stall 21). Thereby, the depth of lower-side web part 51' can be increased.

When ball-receiving surface 51*c* of lower-side web part 51 is provided on an inner side than curved line L2, the depth of the lower-side web part may be insufficient, however, ball-receiving surface 51*c* can be provided on the inner side than curved line L2 as long as the relevant position is closer to the back side of glove 1 than in the conventional constitution shown in FIG. 4.

The "smoothly curved line" recited in the present invention refers to a curved line obtained by smoothly connecting the corresponding parts of thumb stall 20 and forefinger stall 21 with a substantially constant curvature when the glove is in the open state as shown in FIGS. 3 and 4.

Referring to the sectional surfaces of the ball-receiving leather and the web part in the vertical direction, there are steps, gaps and the like between the two members in the conventional glove because they are formed from the separate members. However, in the example of the glove recited in the present invention, wherein the lower-side web part and the ball-receiving leather are formed from a single sheet of leather, the steps, gaps and the like are hardly generated between the two members in comparison to the conventional example. Therefore, when the ball is caught in the vicinity of lower-side web part, the ball can be held as if wrapped in the glove because the area where the ball and the glove are in contact with each other is increased, which results in the improved ball-catching performance.

The preferred embodiments were thus far described. The description of the specification is intended to cover such modifications that a part of the constitutions according to the preferred embodiments is omitted, and the constitutions according to the preferred embodiments are combined.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A catching tool for baseball or softball having a palm side surface and a back side surface comprising:

a front leather having a surface forming a portion of the palm side surface of the tool;

a back leather having a surface forming a portion of the back side surface of the tool;

a thumb stall for receiving a thumb of a user's hand;

a forefinger stall for receiving a forefinger of the user's hand; and a web having a palm side surface and a back side surface disposed between the thumb stall and the forefinger stall, the web comprising an upper portion and a separate lower portion, the upper portion forming a part of the palm side surface of the web above the lower portion, the upper portion of the web disposed proximate the back leather, the lower portion of the web formed from a portion of the front leather, the lower portion of the web forming a portion of the palm side surface of the web, the upper portion of the web formed from a piece of leather separate from the front leather.

2. A catching tool for baseball or softball comprising:

a ball-receiving leather forming a part of a palm side surface of the catching tool and constituting at least a part of a ball-receiving surface;

a back leather forming a part of a back side surface of the catching tool and connected with the ball-receiving leather;

a thumb stall having a base and a tip for receiving a thumb of the user's hand, a forefinger stall having a base and a tip for receiving a forefinger of the user's hand; and a web having a palm surface forming a part of the palm side surface of the catching tool between the thumb stall and the forefinger stall, a part of the web formed from a portion of the ball-receiving leather extending between the thumb stall and forefinger stall, wherein the palm surface of the web at the tips of the thumb stall and forefinger stall is closer to the back side surface than to the palm side surface of the catching tool.

3. The catching tool for baseball or softball according to claim 2, the palm surface of the web slanting from the surface of the ball-receiving leather proximate the base of the thumb stall and the base of the forefinger stall to the surface of the back leather proximate the tip of the thumb stall and the tip of the forefinger stall.

4. The catching tool for baseball or softball according to claim 3, the web having a lower portion disposed proximate the base of the thumb stall and the base of the forefinger stall and a separate upper portion disposed proximate the tip of the thumb stall and the tip of the forefinger stall, wherein the lower portion and the upper portion are not portions of a continuous piece of leather.

5. The catching tool for baseball or softball according to claim 4, wherein the surface area of the lower portion comprises at least 10% of the surface area of the web.

6. The catching tool for baseball or softball according to claim 2, the web having a lower portion disposed proximate the base of the thumb stall and the base of the forefinger stall and a physically separate upper portion disposed proximate the tip of the thumb stall and the tip of the forefinger stall, the back leather and the ball-receiving leather forming the thumb stall and the forefinger stall, the lower portion of the web connecting a portion of the back leather forming the thumb stall to a portion of the back leather forming the forefinger stall.

7. The catching tool for baseball or softball according to claim 2, the web having a lower portion disposed proximate the base of the thumb stall and the base of the forefinger stall and a discrete upper portion disposed proximate the tip of the thumb stall and the tip of the forefinger stall, the lower portion of the web extending from the surface of the ball-receiving leather proximate to the base of the thumb stall and the base of the forefinger stall toward the surface of the back leather such that a lower portion of the web forms a sloped recess in the surface of the ball-receiving leather between the thumb stall and forefinger stall.

8. The catching tool for baseball or softball according to claim 2, the portion of the ball-receiving leather extending between the thumb stall and forefinger stall is folded to form a conduit and a connecting element is inserted through the conduit and attached to the thumb stall and the forefinger stall.

* * * * *